US006766126B2

(12) United States Patent
Hsu et al.

(10) Patent No.: US 6,766,126 B2
(45) Date of Patent: Jul. 20, 2004

(54) MODIFIED CONTROL PANEL USED IN OFFICE MACHINE

(75) Inventors: Ming-Hung Hsu, Nan Tou Hsien (TW); Chi-Chien Lin, Hsin Chu Hsien (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 10/244,423

(22) Filed: Sep. 17, 2002

(65) Prior Publication Data

US 2004/0052544 A1 Mar. 18, 2004

(51) Int. Cl.[7] ..... G03G 15/00; G03G 21/00

(52) U.S. Cl. ..... 399/81; 399/107; 399/380; D18/41

(58) Field of Search ..... 399/81, 107, 367, 399/377, 380; D18/38, 39, 41; 358/474, 496, 497, 401, 501, 296

(56) References Cited

U.S. PATENT DOCUMENTS 4,831,457 A * 5/1989 Watanabe et al. ..... 358/401
4,996,561 A * 2/1991 Yoshimura et al. ..... 399/107
6,163,668 A * 12/2000 Takahashi et al. ..... 399/377 X
D455,779 S * 4/2002 Falk et al. ..... D18/39 X

FOREIGN PATENT DOCUMENTS

JP 05-204058 * 8/1993

* cited by examiner

*Primary Examiner*—Sophia S. Chen
(74) *Attorney, Agent, or Firm*—Birch, Stewart, Kolasch & Birch, LLP

(57) ABSTRACT

A modified control panel used in office machines, which is disposed on an unfoldable upper cover or an automatic document feeder attached on the upper cover without the need of an extra projective portion for disposition of the control panel. Therefore, the machine volume can be effectively shrunk to meet the requirement of miniaturization without affecting operational convenience, thereby reducing material cost and packaging and transportation cost to enhance the competitive capacity of product. The office machine includes a main body, an unfoldable upper cover connected at the main body, and a control panel disposed at the upper cover.

8 Claims, 7 Drawing Sheets

MODIFIED CONTROL PANEL USED IN OFFICE MACHINE

FIELD OF THE INVENTION

The present invention relates to a modified control panel used in office machines and, more particularly, to a modified control panel used in office machines, which is capable of effectively shrinking machine size to meet the requirement of miniaturization without affecting operational convenience, thereby reducing material cost and packaging and transportation cost to enhance the competitive capacity of product.

BACKGROUND OF THE INVENTION

Nowadays, various kinds of OA (office automation) products and information products are required to be miniaturized in design. However, the volume of an existent office machine is still too large, hence not meeting the requirement of miniaturization.

Office machines can roughly be divided into two types: single-function type and multiple-function type. For example, a photocopier, a printer, or a scanner is a single-function office machine, while a multiple-function printer integrating scanning, copying, printing, and faxing together is a multiple-function office machine.

For various kinds of conventional office machines in the market, control panels thereof to be operated and controlled by users are separately disposed at a separate block (projective portion) projecting from the machine. This is because the area for flatbed type scan/copy is very large. In order to prevent from blocking placement and incoming/outgoing of papers, a projective portion is required for the control panel. However, because the projective portion is beyond the main body of the machine, the machine has a larger volume and occupies a larger area, hence not meeting the requirement of miniaturization. Moreover, the design of internal components of the machine will be affected, and material cost and packaging and transportation cost of the machine will increase.

As shown in FIG. 1, a conventional office machine 1 comprises a main body 11, a unfoldable upper cover 12 disposed on the main body 11, and a control panel 13.

As shown in FIG. 2, another conventional office machine 2 comprises a main body 21, an unfoldable upper cover 22 disposed on the main body 21, and a control panel 23. Moreover, an automatic document feeder (ADF) 25 is disposed on the upper cover 22.

In order to keep away from the scan or copy region (i.e., the portion covered by the upper cover in the figures), the control panels 13 and 23 disposed on projective portions 14 and 24 projecting from front sides of the main bodies 11 and 21, respectively. The projective portions 14 and 24 projecting from the machines for disposition of the control panels 13 and 23 let volumes of the conventional office machines 1 and 2 be large, hence not meeting the requirement of miniaturization. Moreover, due to a large volume, material cost and packaging and transportation cost of the machine will be higher. Design of internal components thereof will also be much limited.

Accordingly, the present invention aims to provide a modified control panel applied to office machines so as to resolve the problems in the prior art.

SUMMARY OF THE INVENTION

The primary object of the present invention is to provide a modified control panel used in office machines so as to prevent the control panel from projecting from the machines. Therefore, the machines will have a smaller volume to meet the requirement of miniaturization. Moreover, material cost and packaging and transportation cost of the machines will be lowered. Limit to the design of internal components thereof will also be reduced.

To achieve the above object, the present invention provides a modified control panel used in office machines, which comprises a main body, an unfoldable upper cover connected at the main body, and a control panel disposed at the upper cover. Because the control panel is disposed at the upper cover, the machine size can be effectively shrunk to meet the requirement of miniaturization without affecting operational convenience, thereby reducing material cost and packaging and transportation cost of the machine to enhance the competitive capacity of product.

The various objects and advantages of the present invention will be more readily understood from the following detailed description when read in conjunction with the appended drawing, in which:

DETAILED DESCRIPTION OF THE PREFERRED EMBODIMENTS

Figure 1:
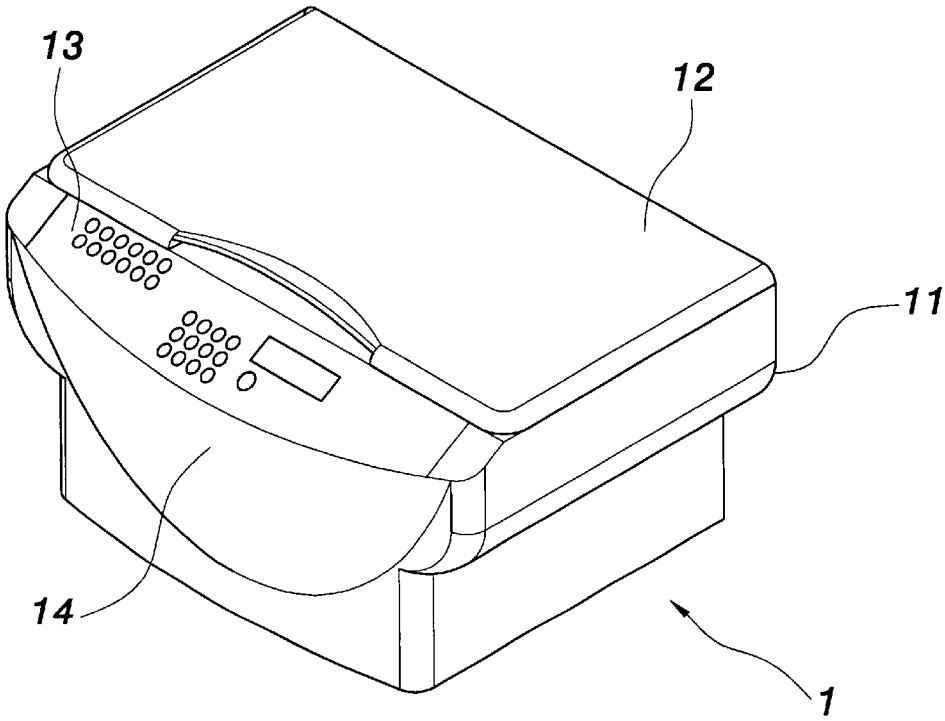
FIG. 1 PRIOR ART
FIG. 1 is a perspective view of a first conventional office machine.
Figure 2:
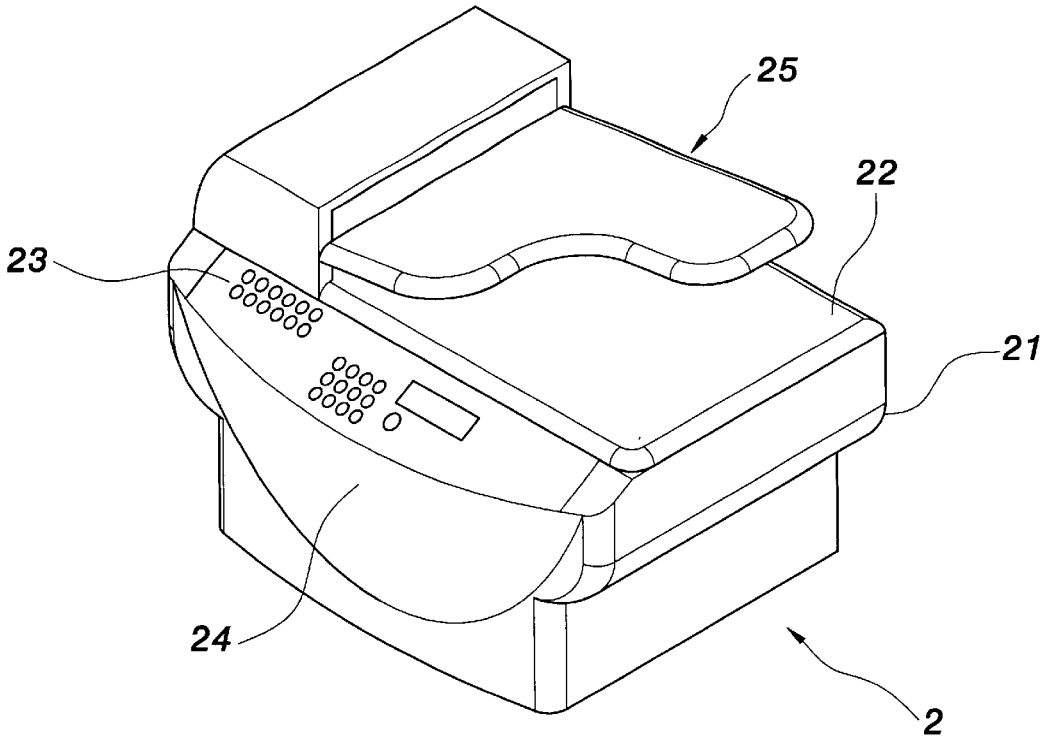
FIG. 2 PRIOR ART
FIG. 2 is a perspective view of a second conventional office machine.
Figure 3:
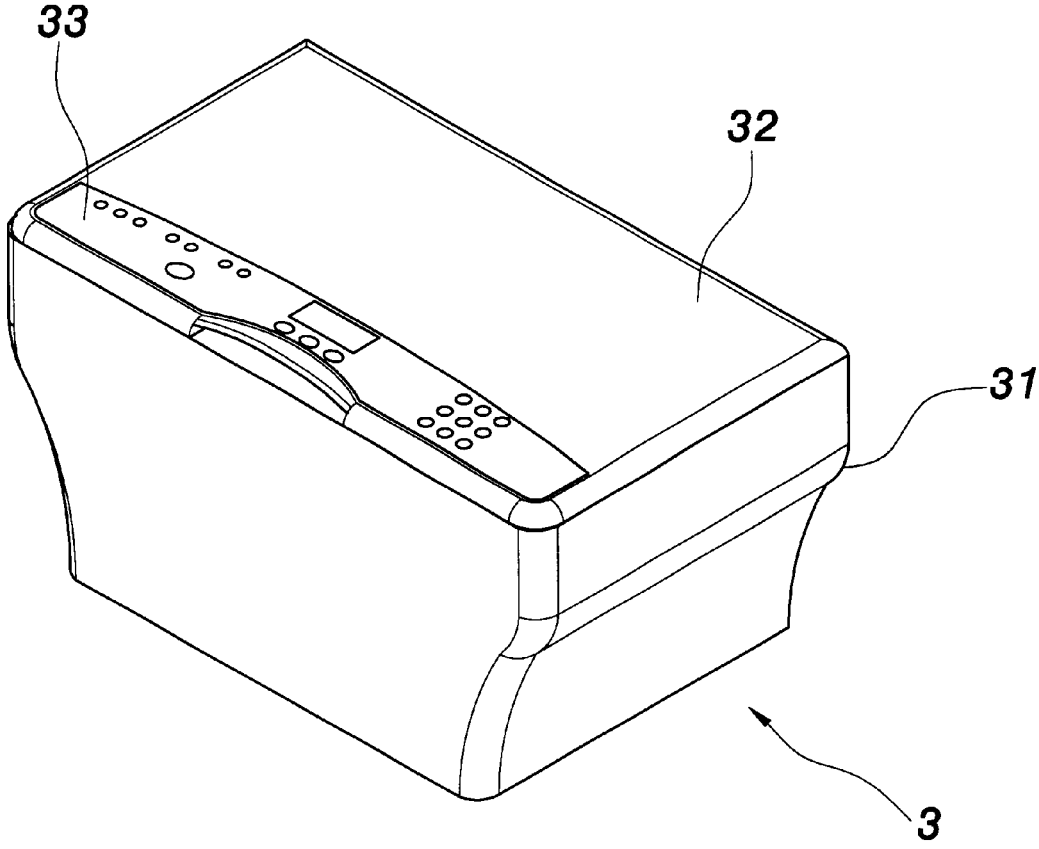
FIG. 3 is a perspective view of a first embodiment of the present invention.
Figure 4:
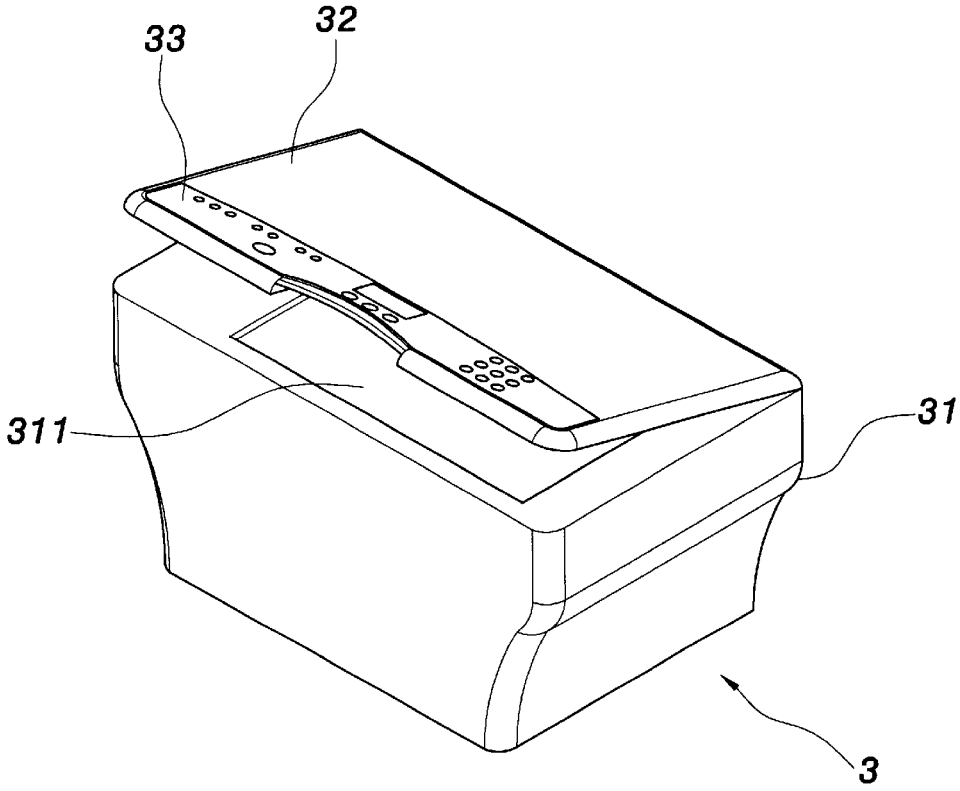
FIG. 4 is a perspective view of the first embodiment of the present invention shown in FIG. 3, wherein an upper cover thereof is unfolded.

As shown in FIGS. 3 and 4, a office machine 3 according to a first embodiment of the present invention comprises a main body 31, an unfoldable upper cover 32 disposed on the main body 31, and a control panel 33.

For the common operations of the office machine, a user needs to unfold the upper cover 32 first, place a document to be copied or scanned on a flatbed glass plate (i.e., a scan/copy region 311 shown in FIG. 4), close the upper cover 32, and then press manipulation keys on the control panel 33 to complete the operational actions. The actions of unfolding the upper cover 32, placing the document, closing the upper cover 32, and manipulating the control panel 33 are a series of individual actions, which will not be performed simultaneously. Therefore, if the control panel 33 is disposed on the upper cover 32, there will be no difficulty in manipulation. In the first embodiment of the present invention, the control panel 33 is disposed on the upper cover 32 to effectively shrink the machine size so as to meet the requirement of miniaturization without affecting operational convenience, thereby reducing material cost and packaging and transportation cost of the machine to enhance the competitive capacity of product.

Figure 5:
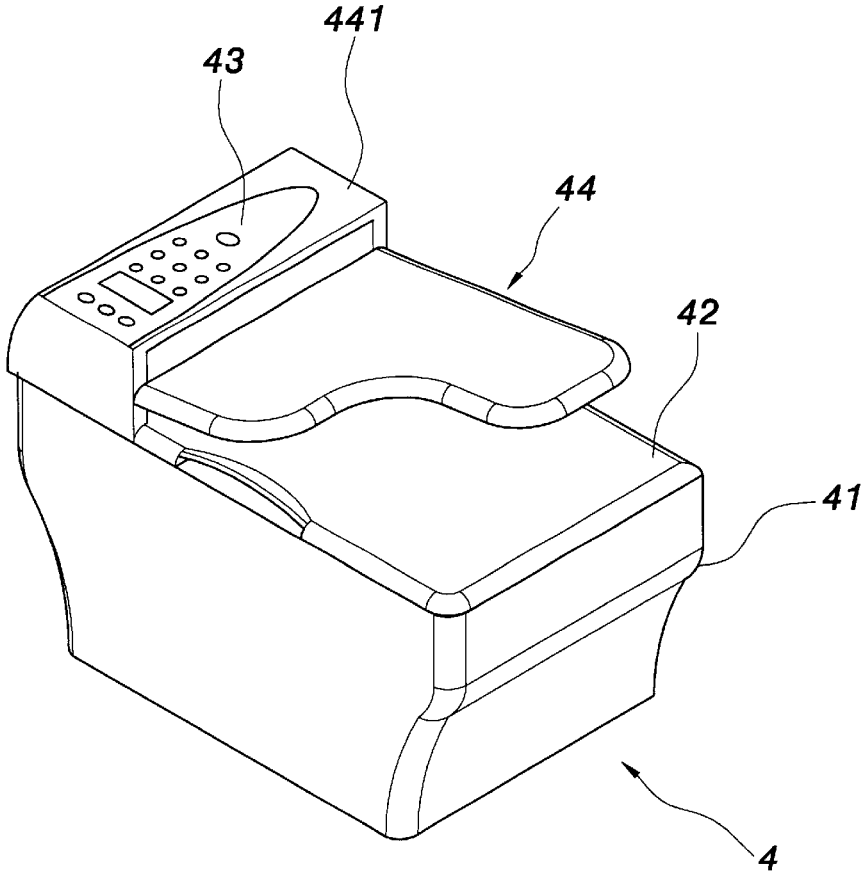
FIG. 5 is a perspective view of a second embodiment of the present invention.
Figure 6:
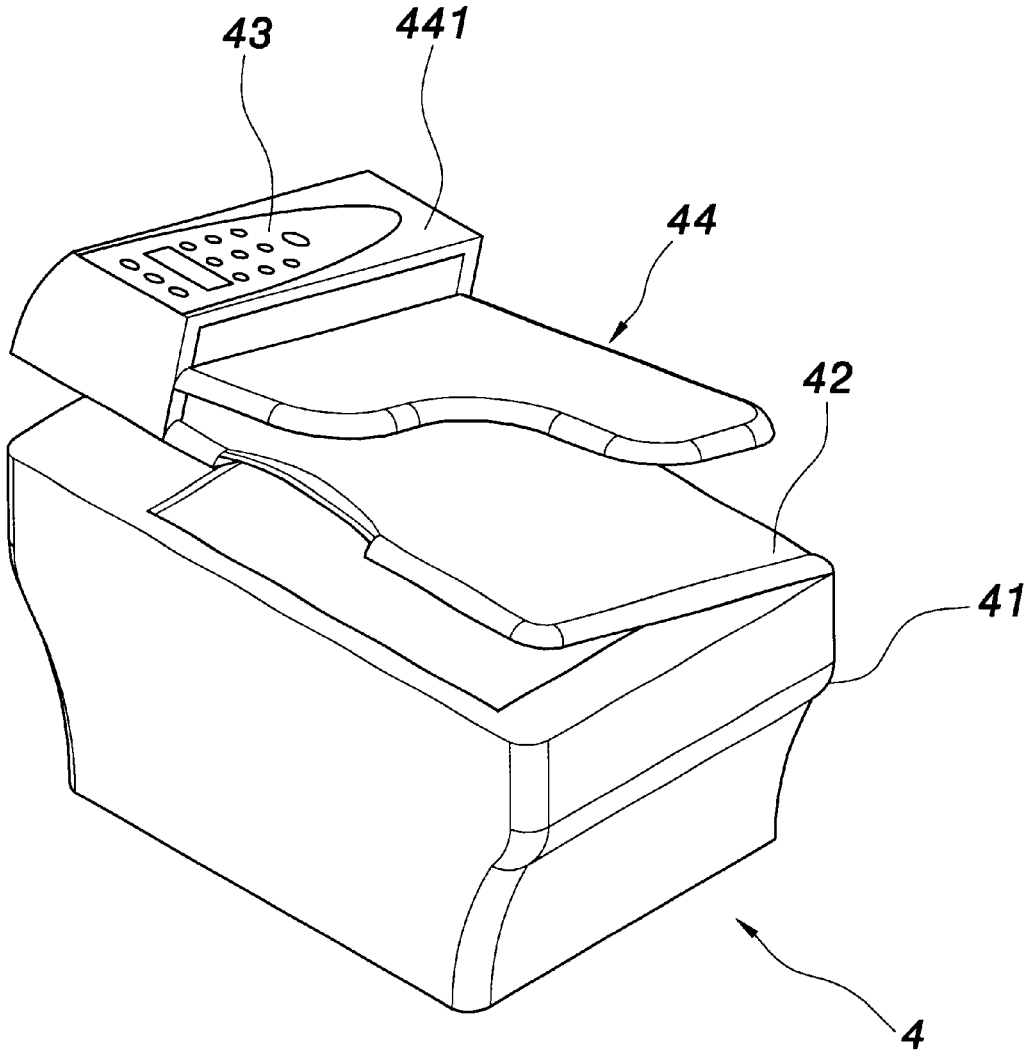
FIG. 6 is a perspective view of the second embodiment of the present invention shown in FIG. 5, wherein an upper cover thereof is unfolded.

As shown in FIGS. 5 and 6, a office machine 4 according to a second embodiment of the present invention comprises a main body 41, an unfoldable upper cover 42 disposed on the main body 41, and a control panel 43. An automatic document feeder (ADF) 44 is further attached on the upper cover 42. The ADF 44 is used as the feed-in basis of document through a housing cover 441 thereof.

For the office machine 4 whose upper cover 42 has the ADF 44 attached thereon, in order to prevent incoming/outgoing papers from blocking the control panel 43, the control panel 43 is not directly disposed on a paper support board (i.e., a slab body slantingly blocking above the upper cover 42) of the ADF 44, but is disposed on the housing cover 441 of the ADF 44.

Of course, in addition to being disposed in visible way, the control panels 33 and 43 can also be disposed in hidden way (not shown). The hidden control panels include eversible type and pull type, which can achieve the same objects and functions.

Figure 7:
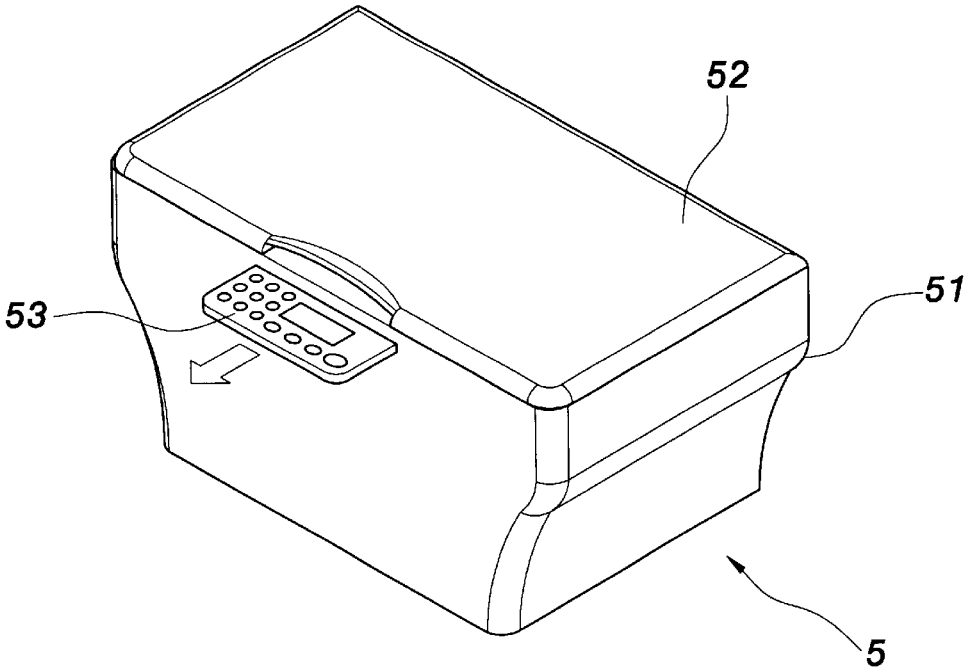
FIG. 7 is a perspective view of a third embodiment of the present invention.

As shown in FIG. 7, a office machine 5 according to a third embodiment of the present invention comprises a main body 51, an unfoldable upper cover 52 disposed on the main body 51, and a control panel 53.

The office machine 5 is approximately the same as the office machine 3 except that the control panel 53 is not disposed on the upper cover 52, but is disposed at the main body 51 in hidden way. The control panel 53 can be of eversible type or pull type. The pull type control panel 53 disposed at the main body 41 is hidden in the main body 51 when not in use. The pull type control panel 53 is pulled out by an external force when in use, as shown in FIG. 7. Therefore, the volume of the machine can be effectively shrunk to meet the requirement of miniaturization.

Because all the operational steps of the office machines 3, 4, and 5 are a series of individual actions, which will not be performed simultaneously, disposition of the control panels 33 and 43 on the upper cover 32 or the housing cover 441 of the ADF 44 (e.g., the visible type of the first and second embodiments or the hidden type not shown) will not affect the manipulations. Moreover, disposition of the control panel 53 at the main body 51 in hidden way (e.g., the third embodiment) also will not affect the manipulation. Therefore, the present invention can effectively shrink machine size to meet the requirement of miniaturization without affecting operational convenience, thereby reducing machine material cost and packaging and transportation cost to enhance the competitive capacity of product.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

What is claimed is:

1. A modified control panel used in office machines, comprising:

a main body;

an upper cover connected on said main body in an unfoldable way; and a control panel disposed at said upper cover, wherein said control panel is disposed in a hidden way.

2. The modified control panel applied to office machines as claimed in claim 1, wherein said hidden control panel is of a pull type.

3. The modified control panel applied to office machines as claimed in claim 1, wherein an automatic feeder is further attached on said upper cover, and said control panel is disposed at said automatic document feeder.

4. The modified control panel applied to office machines as claimed in claim 3, wherein said control panel is disposed on a housing cover of said automatic document feeder.

5. A modified control panel applied to office machines, comprising:

a main body;

an upper cover connected on said main body in an unfoldable way; and a control panel disposed at said upper cover in a hidden way, said control panel can be exposed by an external force.

6. The modified control panel applied to office machines as claimed in claim 5, wherein said control panel is of a pull type.

7. The modified control panel applied to office machines as claimed in claim 5, wherein an automatic document feeder is further attached on said upper cover, and said control panel is disposed at said automatic document feeder.

8. The modified control panel applied to office machines as claimed in claim 7, wherein said control panel is disposed on a housing cover of said automatic document feeder.

* * * * *